US011236977B1

(12) United States Patent
Sullivan

(10) Patent No.: US 11,236,977 B1
(45) Date of Patent: Feb. 1, 2022

(54) BROADHEAD WITH BLADE MOVEMENT RESISTANCE SYSTEM

(71) Applicant: Kevin M. Sullivan, Lakemont, GA (US)

(72) Inventor: Kevin M. Sullivan, Lakemont, GA (US)

( * ) Notice: Subject to any disclaimer, the term of this patent is extended or adjusted under 35 U.S.C. 154(b) by 0 days.

(21) Appl. No.: 17/143,790

(22) Filed: Jan. 7, 2021

Related U.S. Application Data

(60) Provisional application No. 62/958,017, filed on Jan. 7, 2020.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 3,036,395 A * 5/1962 Nelson ..... F42B 30/14 43/6
4,819,360 A * 4/1989 Thomas ..... A01K 81/04 43/6
4,901,467 A * 2/1990 Stolpe ..... A01K 81/04 124/79
5,570,530 A * 11/1996 Lee ..... A01K 81/00 43/1
7,311,621 B2 * 12/2007 Sullivan ..... F42B 6/08 473/583
9,115,962 B1 * 8/2015 Weaver ..... F42B 6/08
9,146,085 B1 * 9/2015 Braun ..... F42B 6/08
9,723,820 B2 * 8/2017 Harshberger ..... A01K 99/00
10,514,238 B2 * 12/2019 Razmus, II ..... F42B 6/08

* cited by examiner

*Primary Examiner* — John A Ricci
(74) *Attorney, Agent, or Firm* — Akerman LLP; Michael K. Dixon

(57) ABSTRACT

A broadhead having at least one movable blade capable of moving between shooting and retraction positions is disclosed. In at least one embodiment, the broadhead may include a plurality of movable blades. The broadhead may include a blade movement resistance system configured to retain the blades in a shooting position while being shot and enable to blades to rotate forward into a retraction position during retraction into a nonbarb position to enable the broadhead to be easily removed from a target or animal. A nonbarb position is one in which the proximal edge of the blade does not form an acute angle with the broadhead or arrow but faces away from the broadhead body or arrow at an obtuse angle.

20 Claims, 3 Drawing Sheets

BROADHEAD WITH BLADE MOVEMENT RESISTANCE SYSTEM

CROSS-REFERENCE TO RELATED APPLICATION

This application claims the benefit of U.S. Provisional Patent Application No. 62/958,017, filed on Jan. 7, 2020, which is incorporated herein in its entirety.

FIELD OF THE INVENTION

This invention is directed generally to broadheads attachable to archery arrows used for hunting, and more particularly to mechanical broadheads having blades that rotate between shooting and retraction positions.

BACKGROUND

Modern broadheads are tips attachable to a distal end of an arrow shaft and include one or more blades having cutting arrises. Modern broadheads are typically either a fixed blade broadhead or a mechanical blade broadhead. Mechanical blade broadheads include blades that move between open and closed positions. The closed position is used for blades during flight and before impact with an animal. Upon impact, the blades move from the closed position into the open position, whereby the cutting diameter is of the broadhead is substantially increased. In the open position, the blades extend outwardly from a generally cylindrical broadhead body. The blades typically extend from the broadhead such that the cutting arris of each blade are at an acute angle relative to a longitudinal axis of the broadhead body and extend from a distal point at an intersection at an outer surface of the broadhead body to near the tip at an outer surface of the broadhead body to a proximal point radially outward of the outer surface of the broadhead body. In this position, the blades are capable of cutting flesh as the broadhead passes through an animal.

SUMMARY

A broadhead having at least one movable blade capable of moving between shooting and retraction positions is disclosed. In at least one embodiment, the broadhead may include a plurality of movable blades. The broadhead may include a blade movement resistance system configured to retain the blades in a shooting position while being shot and enable to blades to rotate forward into a retraction position during retraction into a nonbarb position to enable the broadhead to be easily removed from a target or animal. A nonbarb position is one in which the proximal edge of the blade does not form an acute angle with the broadhead body or arrow but faces away from the broadhead body or arrow at an obtuse angle. Such a configuration enables the broadhead to be constructed of less material than conventional broadheads yet still comply with nonbarb regulations and be lightweight. Being lightweight enables the broadhead to be used with low poundage draw bows, pneumatic arrow guns, blowguns, and the like.

In at least one embodiment, the broadhead for an arrow may be formed from a body configured to be attached to a distal end of the arrow and a tip forming a distal end of the body. The broadhead may include one or more movable blades movably attached to the body. The movable blade may be configured to move between a shooting position and a retraction position. The retraction position eliminates a rearward facing barb configuration of the at least one movable blade. The broadhead may include a blade movement resistance system configured to retain the movable blade in the shooting position when the broadhead is in flight and when engaging a target and may be configured to move the movable blade into the retraction position when the broadhead is being extracted from a target or animal. While this broadhead is a mechanical broadhead with movable blades, this broadhead is not configured like most conventional mechanical broadheads that have blades that are held in a closed position for shooting and open into an open position when contacting a target. Instead, this broadhead with the blade movement resistance system has blades in an open position in the shooting position and in an open position when the blades contact a target. Thus, the movable blades are already in an open position when being shot and are not in a closed position when being shot as with conventional mechanical broadheads. The movable aspect of the blades in the broadhead disclosed herein enable the blades to be moved from a shooting position with the blades open to a retraction position in which the blades are in a nonbarb configuration.

The blade movement resistance system may include one or more resistance bodies positioned such that at least a portion of the movable blade contacts the resistance body when the blade is in the shooting position. The movable blade may be in contact with the resistance body through the entire movement of the movable blade from the shooting position to the retraction position. In other embodiments, the movable blade may be configured such that a portion, such as, but not limited to, a radially inward portion of the movable blade, contacts the resistance body when the movable blade is in the shooting position but does not contact the resistance body when the movable blade is moved from the shooting position. As such, the movable blade may be freely movable, such as capable of flopping back and forth, in the retraction position.

The blade movement resistance system may include one or more receivers configured to receive at least a portion of the resistance body and position the resistance body such that at least a portion of the movable blade contacts a portion of the resistance body when the movable blade is in the shooting position. In at least one embodiment, the receiver may be a chamber positioned in the body. The receiver may be aligned with a longitudinal axis of the body. The receiver may include an opening at a proximal end of the body that is configured to receive the at least one resistance body. Alternatively or in addition, the receiver may include an opening at a distal end of the body that is configured to receive the at least one resistance body. The tip may include a retention stem that protrudes proximally into the opening at the distal end of the body and resides within a portion of the receiver.

The portion of the movable blade that contacts the resistance body may be aligned with the resistance body such that a side surface of the movable blade contacts the resistance body. In another embodiment, the portion of the movable blade that contacts the resistance body is offset with the resistance body such that a corner of a side surface of the movable blade contacts the resistance body. In at least one embodiment, the resistance body may be formed from a crushable material, such as, but not limited to, a monofilament. The movable blade may include a proximal end that resides in a slot that defines movement limitations of the moveable blade and the positions of the movable blade in the shooting position and in the retraction position.

An advantage of this broadhead is that the blade movement resistance system is configured to retain the blades in a shooting position while being shot and to enable blades to rotate forward into a retraction position during retraction into a nonbarb position to enable the broadhead to be easily removed from a target or animal. Such a configuration enables the broadhead to be constructed of less material yet still comply with nonbarb regulations, be lightweight and have minimal aerodynamic resistance.

Another advantage of this broadhead is that the resistance body may be replaced after being used, thereby enabling the broadhead to be shot more than once and the blade movement resistance system still function properly.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
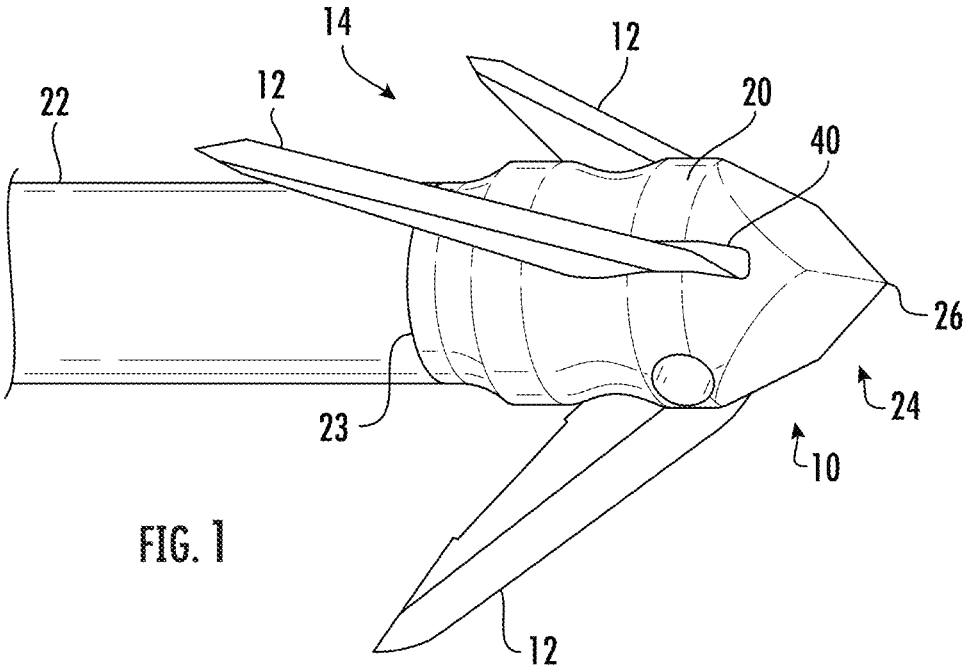
FIG. 1 is a perspective view of a broadhead in the shooting position attached to a distal end of an arrow.
Figure 2:
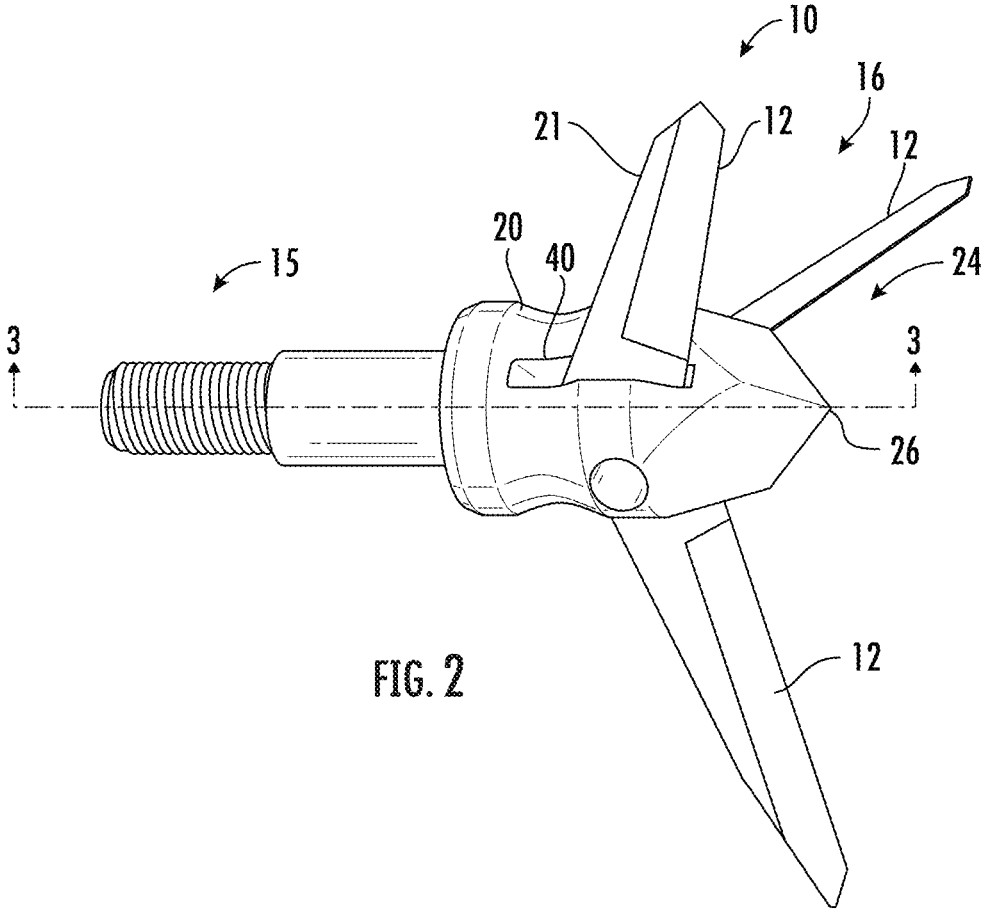
FIG. 2 is a perspective view of the broadhead of FIG. 1 in the retraction position.

As shown in FIGS. 1-6, a broadhead 10 having one or more movable blades 12 capable of moving between a shooting position 14 and a retraction position 16 is disclosed. In at least one embodiment, the broadhead 10 may include a plurality of movable blades 12. The broadhead 10 for an arrow 22 may include a blade movement resistance system 18 configured to retain the blades 12 in a shooting position 14 while being shot and enable to blades 12 to rotate forward during retraction into the retraction position 16, which is a nonbarb position, to enable the broadhead 10 to be removed from a target or animal. The nonbarb retraction position 16 is one in which a proximal edge 21 of the blade 12 does not form an acute angle with the broadhead body 20 or arrow 22 but faces away from the broadhead body 20 or arrow 22 at an obtuse angle. The retraction position 16 eliminates a rearward facing barb configuration of the movable blade 12. Such a configuration enables the broadhead 10 to be constructed of less material than conventional broadheads yet still comply with nonbarb regulations, be lightweight and have aerodynamic advantages. Being lightweight enables the broadhead 10 to be used with lightweight draw bows, blowguns, airguns and the like.

Figure 5:
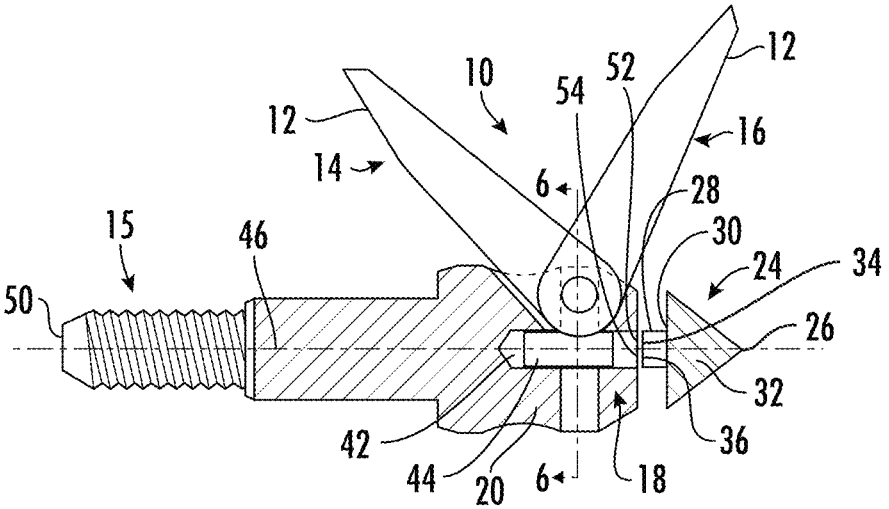
FIG. 5 is a cross-sectional side view of another embodiment of the broadhead of FIG. 1 taken along section line 3-3 in FIG. 2 showing a blade movable between the shooting position and the retraction position.

The broadhead 10 may include a body 20 configured to be attached to a distal end 23 of an arrow 22. The broadhead 10 may be attached to the arrow 22 via a mechanical connection system 15, an adhesive and another manner. The broadhead 10 may include a tip 24 forming a distal end of the body 20 and configured to facilitate penetration of the blade 12 into an object with a pointed distal end 26. In at least one embodiment, as shown in FIG. 5, the tip 24 may include an elongated engaging shaft 28 extending from a proximal end 30 of a head 32 of the tip 24. The elongated engaging shaft 28 may extend from the tip 24 and may include a tip connection assembly 34 at a proximal end 36 of the elongated engaging shaft 28. A proximal end 36 of the elongated engaging shaft 28 may be received within the broadhead body 20. In at least one embodiment in which the receiver 42 includes an opening 52 at a distal end 54 of the body 20, the tip 24 includes an elongated engaging shaft 28 that protrudes proximally into the opening 52 at the distal end 54 of the body 20 and resides within a portion of the receiver 42.

The tip 24 may be pointed and include any appropriate configuration facilitating penetration of the tip 24 into a target, such as an animal or other target. The tip 24 may taper from a point to a cylindrical aft section or have another appropriate cross-sectional shape. In one embodiment, the tip 24 may include three cutting arrises that extend from the point and are separated by surfaces. As such, the tip 24 may be is formed from a trocar having a plurality of cutting arrises. The number of cutting arrises may or may not correspond to the number of blades 12. In one embodiment, the pointed tip 24 may not have any cutting arrises. In another embodiment, the pointed tip 24 may have one or more cutting arrises. The blades 12 may be aligned with the cutting arrises. The tip 24 may be generally cylindrical or have another appropriate shaped outer surface.

Figure 3:
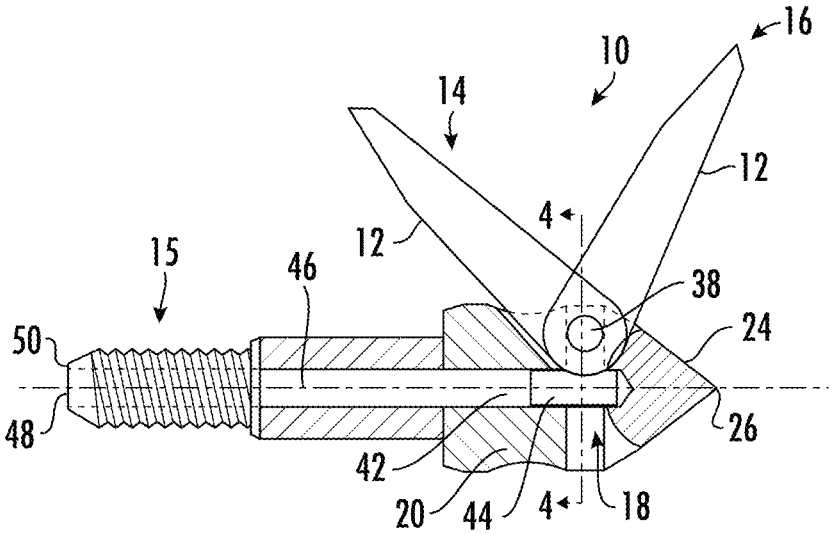
FIG. 3 is a cross-sectional side view of the broadhead of FIG. 1 taken along section line 3-3 in FIG. 2 showing a blade movable between the shooting position and the retraction position.

The broadhead 10 may include one or more movable blades 12 movably attached to the body 20. The broadhead blade or blades 12 may be configured to move between a shooting position 14 and a retraction position 16, as shown in FIGS. 3 and 5. One or more of the blades 12 may be attached to the broadhead body 20 with a pin 38 about which the blade 12 pivots. The pin 38 may be positioned closer to a proximal end of the blade 12 than the distal end. The blade 12, when in the retraction position 16, may at least partially reside within a longitudinal extending slot 40. The slot 40 may receive a proximal end of the movable blade 12 whereby the slot 40 defines movement limitations of the movable blade 12 and the positions of at least one movable blade 12 in the shooting position 14 and in the retraction position 16. The slot 40 may also be configured such that the slot 40 houses a proximal portion of the movable blade 12. Other components such as, but not limited to, a cross-pin or other components could establish movement limitations to the movable blade 12 relative to the body 20.

The broadhead 10 may include a blade movement resistance system 18 configured to retain the movable blade 12 in the shooting position 14 when the broadhead 10 is in flight and when engaging a target and may be configured to move the movable blade 12 into the retraction position 16 when the broadhead 10 is being extracted from a target. The blade movement resistance system 18 may include one or more receivers 42 configured to receive at least a portion of one or more resistance bodies 44 and position the resistance body 44 such that at least a portion of the movable blade 12 contacts a portion of the resistance body 44 when the movable blade 12 is in the shooting position. In at least one embodiment, the receiver 42 may be a chamber 42 positioned within the broadhead body 20. In at least one embodiment, the chamber 42 may be aligned with a longitudinal axis 46 of the broadhead body 20. In other embodiments, the chamber may be nonparallel with the longitudinal axis 46 of the broadhead body 20. As shown in FIG. 3, the receiver 42 may include an opening 48 at a proximal end 50 of the broadhead body 20 configured to receive the resistance body 44 or an opening 52 at a distal end 54 of the broadhead body 20, or both. In at least one embodiment, the receiver 42 may be, but is not limited to being, cylindrical. In other embodiments, the receiver 42 may have other cross-sectional shapes.

The blade movement resistance system 18 may include one or more resistance bodies 44 positioned such that at least a portion of the movable blade 12 contacts the resistance body 44 when the movable blade 12 is in the shooting position 14. In at least one embodiment, the resistance body 44 may be formed from any material capable of imparting a force against the blade 12 yet allow the blade to rotate with the force generated being shot from a bow, crossbow, blowgun and the like. The resistance body 44 may be formed from a crushable material. The crushable material, may be, but is not limited to being, a piece of monofilament. The crushable material may have any appropriate length and size, and in at least one embodiment may be, but it not limited to being, between 0.15 mm and 5 mm in diameter. The movable blades 12 may be configured and positioned within the body 20 such that when the movable blades 12 are installed in the broadhead body 20 via the pins 38, a portion of the blade 12 protrudes into contact with the resistance body 44. As such, the resistance body 44 in the receiver 42 provides a force against the blade 12. If the blade 12 is attempted to be moved, friction is created and limits movement of the blade 12 until enough force is generate to overcome the friction and allow the blade 12 to move, such as from a shooting position 14 to a retraction position 16 or vice versa.

Figure 4:
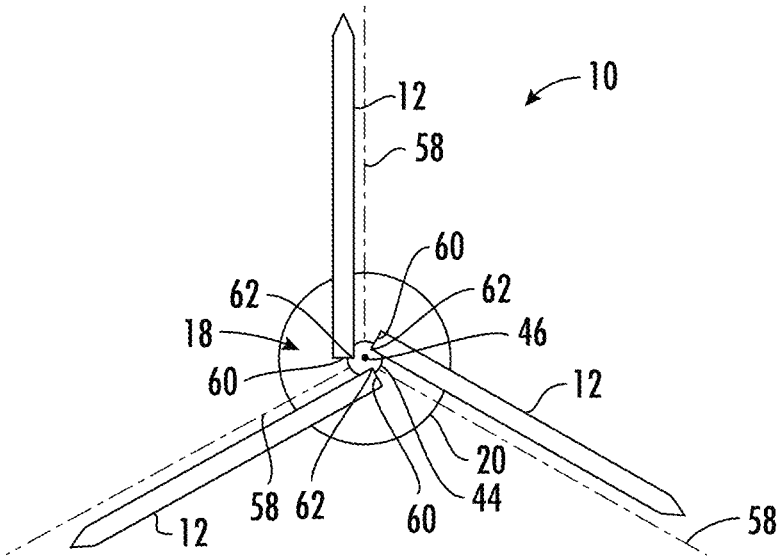
FIG. 4 is an end cross-sectional view of the broadhead taken at section line 4-4 in FIG. 3 illustrated without pins holding the blades in place.
Figure 6:
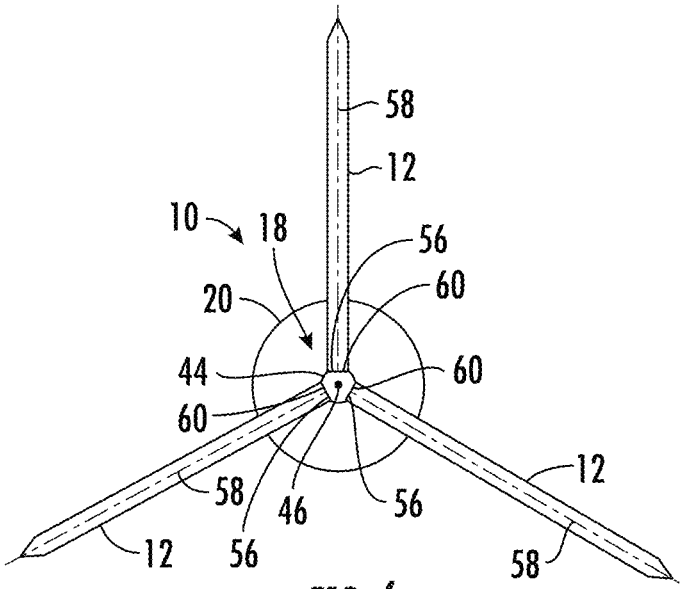
FIG. 6 is an end cross-sectional view of another embodiment of the broadhead taken at section line 6-6 in FIG. 5 illustrated without pins holding the blades in place.

In at least one embodiment, as shown in FIG. 6, the portion 60 of the movable blade 12 that contacts the resistance body 44 may be aligned with the resistance body 44 such that a side surface 56 of the movable blade 12 contacts the resistance body 44. In such an embodiment, the blades 12 may be aligned with axes 58 extending radially outward from the longitudinal axis 46 of the body 20. In another embodiment, as shown in FIG. 4, the portion 60 of the movable blade 12 that contacts the resistance body 44 may be offset with the resistance body 44 such that a corner 62 of a side surface 56 of the movable blade 12 contacts the resistance body 44. In such an embodiment, the blades 12 may be offset laterally from axes 58 extending radially outward from the longitudinal axis 46 of the body 20. The movable blade 12 is not limited to only contacting the resistance body 44 in these two manners. Instead, other portions of the movable blade 12, such as, but not limited to, a side or other aspect of the movable blade 12, may be configured to contact the resistance body 20. As such, any portion of the movable blade 12 or extension of the movable blade 12 that is configured to contact the resistance body 44 may be used to contact the resistance body 44.

During use, as a blade 12 contacts material, such as an animal hide, the blade movement resistance system 18 causes the blade 12 to stay in the shooting position 14. When the broadhead 10 is removed from a target or animal, the blade 12 rotates about the pin attaching the blade 12 to the broadhead body as the retraction force overcomes the friction force created by the crushable material in the chamber of the blade movement resistance system 18. The blades 12 then move into the retraction position 16 in which the blades 12 are pointed forward and do not form a rearward facing barb, thereby complying with some U.S. state laws prohibiting barbed broadheads.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A broadhead for an arrow, comprising:

a body configured to be attached to a distal end of the arrow;

a tip forming a distal end of the body;

at least one movable blade movably attached to the body;

wherein the at least one movable blade is configured to move between a shooting position and a retraction position; and a blade movement resistance system configured to retain the at least one movable blade in the shooting position when the broadhead is in flight and when engaging a target and configured to allow movement of the at least one movable blade into the retraction position when the broadhead is being extracted from a target;

wherein the blade movement resistance system comprises at least one resistance body positioned such that at least a portion of the at least one movable blade contacts the at least one resistance body when the at least one movable blade is in the shooting position;

wherein the blade movement resistance system comprises at least one receiver configured to receive at least a portion of the at least one resistance body and position the at least one resistance body such that at least a portion of the at least one movable blade contacts a portion of the at least one resistance body when the at least one movable blade is in the shooting position; and wherein the at least one receiver comprises an opening at a distal end of the body that is configured to receive the at least one resistance body.

2. The broadhead of claim 1, wherein the tip includes an elongated engaging shaft that protrudes proximally into the opening at the distal end of the body and resides within a portion of the at least one receiver.

3. The broadhead of claim 1, wherein the at least one resistance body is formed from a crushable material.

4. The broadhead of claim 1, wherein the at least one receiver is a chamber positioned in the body and the at least one receiver is aligned with a longitudinal axis of the body.

5. A broadhead for an arrow, comprising:

a body configured to be attached to a distal end of the arrow;

a tip forming a distal end of the body;

at least one movable blade movably attached to the body;

wherein the at least one movable blade is configured to move between a shooting position and a retraction position;

a blade movement resistance system configured to retain the at least one movable blade in the shooting position when the broadhead is in flight and when engaging a target and configured to allow movement of the at least one movable blade into the retraction position when the broadhead is being extracted from a target;

wherein the blade movement resistance system comprises at least one resistance body positioned such that at least a portion of the at least one movable blade contacts the at least one resistance body when the at least one movable blade is in the shooting position; and wherein the portion of the at least one movable blade that contacts the at least one resistance body is aligned with the at least one resistance body such that a side surface of the at least one movable blade contacts the at least one resistance body.

6. The broadhead of claim 5, wherein the blade movement resistance system comprises at least one receiver configured to receive at least a portion of the at least one resistance body and position the at least one resistance body such that at least a portion of the at least one movable blade contacts a portion of the at least one resistance body when the at least one movable blade is in the shooting position.

7. The broadhead of claim 6, wherein the at least one receiver is a chamber positioned in the body.

8. The broadhead of claim 6, wherein the at least one receiver is aligned with a longitudinal axis of the body.

9. The broadhead of claim 6, wherein the at least one receiver comprises an opening at a proximal end of the body that is configured to receive the at least one resistance body.

10. The broadhead of claim 5, wherein the retraction position eliminates a rearward facing barb configuration of the at least one movable blade.

11. The broadhead of claim 5, wherein the at least one movable blade includes a proximal end that resides in a slot that defines movement limitations of the at least one movable blade and the positions of at least one movable blade in the shooting position and in the retraction position.

12. The broadhead of claim 5, wherein the at least one resistance body is formed from a crushable material.

13. A broadhead for an arrow, comprising:

a body configured to be attached to a distal end of the arrow;

a tip forming a distal end of the body;

at least one movable blade movably attached to the body;

wherein the at least one movable blade is configured to move between a shooting position and a retraction position;

a blade movement resistance system configured to retain the at least one movable blade in the shooting position when the broadhead is in flight and when engaging a target and configured to allow movement of the at least one movable blade into the retraction position when the broadhead is being extracted from a target;

wherein the blade movement resistance system comprises at least one resistance body positioned such that at least a portion of the at least one movable blade contacts the at least one resistance body when the at least one movable blade is in the shooting position; and wherein the portion of the at least one movable blade that contacts the at least one resistance body is offset with the at least one resistance body such that a corner of a side surface of the at least one movable blade contacts the at least one resistance body.

14. The broadhead of claim 13, wherein the at least one resistance body is formed from a crushable material.

15. The broadhead of claim 13, wherein the blade movement resistance system comprises at least one receiver configured to receive at least a portion of the at least one resistance body and position the at least one resistance body such that at least a portion of the at least one movable blade contacts a portion of the at least one resistance body when the at least one movable blade is in the shooting position and wherein the at least one receiver comprises an opening at a proximal end of the body that is configured to receive the at least one resistance body.

16. The broadhead of claim 15, wherein the at least one receiver is a chamber positioned in the body and the at least one receiver is aligned with a longitudinal axis of the body.

17. A broadhead for an arrow, comprising:

a body configured to be attached to a distal end of the arrow;

a tip forming a distal end of the body;

at least one movable blade movably attached to the body;

wherein the at least one movable blade is configured to move between a shooting position and a retraction position; and a blade movement resistance system configured to retain the at least one movable blade in the shooting position when the broadhead is in flight and when engaging a target and configured to allow movement of the at least one movable blade into the retraction position when the broadhead is being extracted from a target;

wherein the blade movement resistance system comprises at least one resistance body positioned such that at least a portion of the at least one movable blade contacts the at least one resistance body when the at least one movable blade is in the shooting position;

wherein the at least one resistance body is formed from a crushable material.

18. The broadhead of claim 17, wherein the at least one resistance body is formed from a monofilament.

19. The broadhead of claim 17, wherein the blade movement resistance system comprises at least one receiver configured to receive at least a portion of the at least one resistance body and position the at least one resistance body such that at least a portion of the at least one movable blade contacts a portion of the at least one resistance body when the at least one movable blade is in the shooting position and wherein the at least one receiver comprises an opening at a proximal end of the body that is configured to receive the at least one resistance body.

20. The broadhead of claim 19, wherein the at least one receiver is a chamber positioned in the body and the at least one receiver is aligned with a longitudinal axis of the body.

* * * * *